United States Patent [19]

Hammond

[11] 4,323,368

[45] Apr. 6, 1982

[54] GASIFICATION OF COAL

[75] Inventor: Ogden H. Hammond, Arlington, Mass.

[73] Assignee: Massachusetts Institute of Technology, Cambridge, Mass.

[21] Appl. No.: 766,931

[22] Filed: Feb. 8, 1977

Related U.S. Application Data

[63] Continuation-in-part of Ser. No. 660,637, Feb. 23, 1976, abandoned, which is a continuation of Ser. No. 506,269, Sep. 16, 1974, abandoned.

[51] Int. Cl.[3] ..... C10J 3/16; C01B 2/00

[52] U.S. Cl. ..... 48/202; 252/372

[58] Field of Search ..... 252/372; 48/202, 206, 48/197 R

[56] References Cited

U.S. PATENT DOCUMENTS 3,503,724 3/1970 Benson ..... 48/197 R 3,619,142 11/1971 Johnson ..... 48/197 R

FOREIGN PATENT DOCUMENTS 266311 4/1928 United Kingdom ..... 48/197 R

*Primary Examiner*—Alan Siegel

*Attorney, Agent, or Firm*—Arthur A. Smith, Jr.; Anthony M. Lorusso

[57] ABSTRACT

Improvements in the known steam-iron coal gasification process. Coal and iron particles are cofluidized in a gas producing zone and agglomeration of the particles is prevented by including at least 30% and, as the temperature is raised within the operable range, 60% or even 90% or more iron in the mix. The FeO produced as a by-product is transferred to a regeneration zone where, preferably, one of two iron oxide reduction processes are utilized. One regeneration process comprises reacting the FeO in a dense fluidized bed with a mixture of CO and $CO_2$. The other process involves cofluidizing FeO and CaO with a $CO$–$CO_2$ mixture to produce iron and calcium compounds which may be separated from the iron prior to its introduction back into the gas producing zone.

11 Claims, 6 Drawing Figures

GASIFICATION OF COAL

REFERENCE TO RELATED APPLICATIONS

This application is a continuation-in-part of application Ser. No. 660,637, filed Feb. 23, 1976 now abandoned, which was a continuation of application Ser. No. 506,269, filed Sept. 16, 1974 now abandoned.

BACKGROUND OF THE INVENTION

This invention relates to a process for forming combustible liquid and gaseous light hydrocarbons from carbonaceous materials. More particularly, it relates to improvements in the known steam-iron process for gasification of materials such as coal.

The so called steam-iron process for producing methane rich gases is essentially a two step procedure wherein, in a first step, steam is contacted with iron and particulate carbonaceous solids at a temperature and pressures such that light hydrocarbons and FeO are produced (gas producing stage). The oxidized iron is then transferred to a zone wherein, as a second step, it is reduced to form iron and recycled (iron reduction stage).

While this process is per se old, prior art attempts at commercialization directed to forming methane or mixtures of methane and other low molecular weight combustible liquids or gases as a substitute for natural gas have been fraught with significant problems. One problem is that of agglomeration of the carbonaceous materials in the gas producing stage. When heated to the temperature required to effect the gasification reaction, carbonaceous material particles tend to stick together to form large agglomerates or "klinkers" and to produce other tarry deposits which clog the apparatus employed, seriously reduce the theoretical efficiency of the reactions, and effectively prohibit the design of a smooth running continuous process. Coals having a high net hydrogen to carbon ratio are particularly susceptible to this behavior. Bituminous coal particles, for example, when heated to a temperature on the order of 600° K., form a sticky liquid surface layer which acts as a binder for adjacent similar particles. This phenomenon results in debilitating decreases in reaction rates because of the decrease in surface area of the solids reacting and the clogging problems.

Another problem inherent in the prior art steam-iron process is that of reducing the iron oxide for recycling. Obviously, the cost of recycling must be very low in order to minimize the cost of the gas produced. One proposed iron-oxide reduction process involves contacting the iron oxides with solid carbonaceous materials. However, this method of reduction is relatively slow due to the notoriously poor kinetics of reactions dependent on solid-solid contact. Another known iron reduction process involves utilizing carbon monoxide or a mixture of carbon monoxide and hydrogen as a reducing agent. Hydrogen, of course, is quite expensive. Furthermore, in the case of both hydrogen and carbon monoxide, large amounts of gas are required because of the low equilibrium conversion characteristics of reduction using these gases. Low reaction rates necessarily result in large and expensive reactors.

Other disadvantages of the prior art processes include unacceptably low breakdowns of steam, thereby requiring means to condense large volumes of steam with the attendant generation of large quantities of relatively useless low temperature heat. Furthermore, because of the inefficiencies inherent in the gas producing stage, the prior art processes frequently produced significant quantities of carbon monoxide together with the low molecular weight hydrocarbons. This occurred primarily in prior art processes which utilized insufficient quantities or surface area of metallic iron such that they were kinetically controlled.

SUMMARY OF THE INVENTION

It has now been discovered that control of certain critical parameters in the steam-iron process can improve the process so that a low molecular weight hydrocarbon rich gas can be formed rapidly and more efficiently than was heretofore possible. A key development in this improvement has been the discovery of a way of minimizing agglomeration of particles.

The improved process is characterized by the steps of cofluidizing iron particles and carbonaceous particles in a container and contacting the cofluidized particles with steam at a temperature between about 600 and 1125° K. As is known in the art, cofluidizing requires that the range of diameters of the particles be fixed in a relationship to their densities. When the reactants are contacted in a cofluidized bed under a pressure in the range of 1 to 100 atmospheres, significant improvements in reaction rates and efficiency are realized.

However, it has also been discovered that even greater improvements are possible if the weight percent of iron particles in the cofluidized bed is at least 30. As the temperature of reaction is raised within the operable range of 600°–1125° K., the percentage of iron particles should be increased so that, between 800°–1000° K., the amount of iron is at least 60%, and at 850° K. or higher, the amount of iron in the cofluidized bed should preferably be 90% or above.

These discoveries enable economic gasification and/or liquification of the domestically abundant bituminous coal and other high hydrogen to carbon ratio carbonaceous materials.

In accordance with another aspect of the invention, novel methods of reducing iron oxide for recylcing which are particularly well adapted for the steam-iron process are provided. Thus, in one important embodiment of the process, FeO is reduced by contacting it with a gas stream containing carbon monoxide and carbon dioxide. The $CO/CO_2$ mole ratio is selected to favor the production of iron in the reaction:

$$CO + FeO \rightleftharpoons CO_2 + Fe$$

The gas stream contacts the FeO, preferably in a fluidized bed, at a temperature between about 900°–1300° K. and the pressure between about 1 and 45 atmospheres. Carbon monoxide is consumed during the reduction, but is also produced as the carbon dioxide reacts with carbon in the char which comes over together with the iron oxide from the cofluidized gas producing bed by the reaction:

$$CO_2 + C\ (char) \rightarrow 2CO$$

Thus, a carbon monoxide rich gas stream is isolated from the effluent of the iron reduction reactor by simply removing the carbon dioxide from the effluent with a conventional $CO_2$ scrubber. The CO rich stream is then recycled to provide the CO which is primarily responsible for the reduction of the iron oxide. Furthermore, the temperature in the reduction zone may be maintained by oxidizing a portion of the carbon monoxide in the stream.

In another important embodiment of the process, the iron oxide is reduced by cofluidizing the particles in the solid stream with calcium oxide and a mixture of carbon monoxide and carbon dioxide at a temperature of between 900°–1300° K. In this embodiment, calcium compounds and iron are produced, and because of the size difference of the particles in the cofluidized bed, the calcium compounds, chiefly $CaCO_3$ and CaS, may be separated from the iron by utilizing the difference in particle size, e.g., by using a screen.

At this point, it should be noted that the chemistry in the foregoing processes has been known for at least fifty years. See, for example, Great Britain Pat. No. 266,311 to A. Gaertner, dated Jan. 27, 1927. Furthermore, that CaO, carbon, and FeO when mixed together and heated can produce iron has been known for thousands of years. Thus the improvements set forth herein are directed to smoothing and economizing the reactions involved and providing a process utilizing a combination of known reactions which can greatly reduce the cost of treating carbonaceous materials to produce more convenient, clean burning, and easily handled fuels.

Accordingly, it is a primary object of the invention to provide a process for reacting carbonaceous materials, and particularly soft coals, with water to produce low molecular weight hydrocarbons, e.g., methane rich gases and/or light hydrocarbon liquids, depending on the temperature at which the reactions are conducted.

Another object of the invention is to effect the gasification of coal while greatly reducing the tendency of coal particles to agglomerate and to form other sticky, hard to manage deposits.

Another object of the invention is to utilize the iron present as an impurity in many soft coals and other carbonaceous materials as a replacement for the unavoidable losses of iron in the steam-iron process.

Another object of the invention is to provide a carbonaceous material gasification process which may be run on a continuous basis and produces light hydrocarbons having a low carbon monoxide and sulfur containing gas content.

Still another object of the invention is to provide efficient methods of reducing iron oxide which are particularly useful in the context of the gasification process disclosed herein and which heavily contribute to an economical and smooth running procedure.

Another object of the invention is to provide methane rich gases at a price which is competitive with that of natural gas.

Yet another object of the invention is to provide a process of the type described which can utilize a wide variety of carbonaceous materials ranging from coals to oil shales.

These and other objects of the invention will be apparent to those skilled in the art from the following description of a preferred embodiment and from the drawing:

DESCRIPTION OF THE PREFERRED EMBODIMENT

Figure 1:
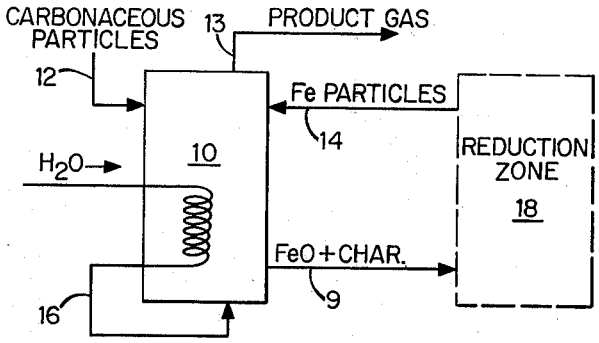
FIG. 1 is a diagram schematically illustrating certain features of the process of the invention.

Referring to FIG. 1, a gas producing zone 10 is fed with carbonaceous particles through line 12, iron particles through line 14, and steam through line 16. The pressure in gas producing zone 10 is between 1 and 100 atmospheres, preferably between about 20 and 100 atomspheres. The temperature within zone 10 must be maintained sufficiently high to effect the desired set of reactions rapidly without being so high as to lead to the formation of excessive amounts of carbon monoxide and/or carbon dioxide. Accordingly, the temperature in zone 10 is maintained between about 600°–1125° K. preferably between about 800°–1000° K., and optimally about 850° K. When operating at these conditions, the following reactions, among others, occur to produce a gas rich in low molecular weight hydrocarbons:

$$H_2O + Fe \rightarrow FeO + H_2 \qquad 1$$

$$nCO + (2n+1)H_2 \rightarrow C_nH_{2n+2} + nH_2O \qquad 2$$

The latter reaction is known as the Fischer-Tropsch reaction and is catalized by iron and its oxides.

A complex series of reactions involving the volatile components of the carbonaceous materials, the metallic iron, and steam also take place. Specifically, as the coal or other carbonaceous materials approach the lower range of the reaction temperature, a sticky liquid forms on the surface of the carbonaceous particles. When finely divided metallic iron and steam come into contact with the liquid, a series of reactions takes place which result in the hydrogenation and cracking of the organic liquid film on the particle surface. This mechanism also results in the production of light hydrocarbons and is known in the art as devolatilization.

The product of the reactions which take place in the gas producing zone 10 typically comprises a mixture of low molecular weight (approx. $C_1$–$C_{10}$), predominantly saturated hydrocarbons. Trace amounts of other gases, e.g., hydrogen, may also result. In general, the higher the reaction temperature, the greater amount of gaseous hydrocarbons produced, e.g., methane, ethane, propane, etc. As the temperature is lowered within the operable range, the product stream will contain increasing amounts of hydrocarbons that will condense to form a liquid at room temperature.

The types of carbonaceous materials which may be used in the foregoing process include but are not limited to bituminous coal, lignite coal, subituminous coal, oil shales, tar sands, and bituminous impregnated rock. Furthermore, carbon monoxide gas may be added together with any of the above, e.g., mixed with the incoming steam. Addition of carbon monoxide has beneficial effects on the reaction.

As can be seen from the above equations, iron oxide is a principal product generated in the gas production zone 10. This iron oxide, together with unreacted carbon and miscellaneous materials such as ferrous sulfide, is transferred out of the gas production zone and into a reduction zone where the FeO is reduced to iron for recycling. Further particulars of the reduction process will be set forth hereinafter.

Principal drawbacks of the above disclosed process include the facts that the rate of reaction within the gas production zone 10 is unacceptably low and the carbonaceous materials of the type set forth above tend to agglomerate and clog the system. This behavior is particularly troublesome when operating with high net hydrogen to carbon ratio carbonaceous material. At the operational temperature, these materials, particularly soft coal, become quite sticky, interfere with the proper functioning of the reactor, and inevitably produce larger agglomerates which have a low surface area to mass ratio. Accordingly, both the reaction rate and the smooth handling of the solid streams suffer.

However, in accordance with the invention, these effects are diminished or prevented by operating the gas production zone as a cofluidized bed and by controlling the relative weight of coal and iron particles used. Cofluidizing refers to the known technique of maintaining a well-mixed bed of two or more substances in intimate contact by adjusting the particle sizes of the respective substances fed into the bed within certain critical ranges and passing a gas upwardly therethrough. The operable particle size ranges are dictated by the densities of the cofluidized solids. In accordance with the invention, it is preferred to cofluidize using iron and crbonaceous material particles each having various diameters within the operable range for cofluidization. Operating in this manner has been observed to result in a more efficient process than one in which, for example, the respective particle size are carefully controlled to optimize the cofluidization phenomenon.

Thus, coal and iron particles having respective diameter ranges within the known ratio suitable for cofluidization are simultaneously introduced into the reactor and are cofluidized by the rising, high temperature steam. When minimal amounts of iron are used (e.g., 10% by weight), the carbonaceous particles quickly become sticky when contacted with steam. On collision, the coal particles agglomerate and form larger particles. These soon become too large to be fluidized and fall from the fluidized region onto the bed support, obstructing gas flow, and preventing uniform fluidization. This results in an extremely inefficient process which is characterized by low reaction rate and a break down of the continuity of the process.

The addition of certain larger amounts of iron particles of suitable diameter to the reactor leads to significant reductions in agglomeration. Thus, the fluidized bed is stabilized, the reaction rate is promoted by the intimate contact between the reacting particles and the gas in the reactor, and a continuous process may be designed. The finely divided iron particles rapidly coat the carbonaceous particles and act as a thermal conductor to quickly bring the reactants to the reaction temperature.

This phenomenon, in and of itself, enables a system to be designed wherein the residence time and the reactor size may be diminished. However, it has further been discovered that agglomeration is greatly reduced and in some cases prevented if at least 30% by weight iron, and more preferably 60% iron is added to the particulate feed. Within the temperature range at which the hydrocarbons are produced, the higher the temperature selected, the greater should be the weight percent of iron in the feed mix. In this regard, for example, it has been discovered that amounts of iron in excess of 90% by weight produce very beneficial results at high, particularly efficient temperatures, e.g., at or above about 850° K.

The reasons for this behavior, although not clearly understood, have been hypothesized to be as follows. The low thermal conductivity of the coal, in the absence of any iron in the mix, results in a long time being required to bring the bed temperature up to the reaction temperature. Thus, pure coal requires a longer period of time to reach agglomeration temperatures, and agglomeration is quite slow. The presence of small amount of iron in the bed abruptly increases its thermal conductivity. This results in the coal particles reaching the agglomeration temperature much sooner, and thus in a more rapid overall rate of agglomeration. Coal particles and iron thus adhere to one another forming "klinkers" and agglomerates which descend and form a cake.

In the presence of larger amounts of iron, e.g., at least 30% by weight, although thermal transfer increases and thus agglomeration quickly begins, the larger excess of iron as compared to that needed to virtually maximize the heat transfer rate coats the carbonaceous particles more thoroughly, and provides a non-sticky surface. This apparently occurs early enough to act as a form of "insulation", preventing substantial coal-to-coal agglomeration.

The foregoing proposed mechanism is based, in part, on the empirical data set forth below which demonstrates the phenomenom exploited in the process of the invention.

EXAMPLE

The following data was derived by cofluidizing a mixture of iron and coal particles of known sizes, densities, and weight fractions with streams of inert 673° K. gas, e.g., the lower portion of the operative temperature range. In each run, after a predetermined time had elapsed, average particle sizes and distributions were determined by screening and comparing the particles produced with initial particle size distribution. Particle size was measured using seives, the mesh numbers and openings in microns being as set forth in Table I.

TABLE I

| U.S. MESH NUMBER | OPENING (μ) |
|---|---|
| 30 | 590 |
| 40 | 420 |
| 45 | 351 |
| 60 | 250 |
| 100 | 149 |

Tables II and III, set forth below, show data for two sets of runs, one for five minutes, and one for fifteen minutes. A significant entry in each column of these tables is the value of I which gives the ratio of the final average diameter of the coal particles to the initial average diameter, i.e., provides an indication of the degree of agglomeration which occurrs during the elapsed time. Another significant entry in these data is the value of C, which is defined as the weight of particles retained by the 30 mesh (590μ) screen divided by the total weight of the sample. The tables disclose the total mass of coal particles employed at the outset in each run and the masses of particles of various sizes at the end of the procedures. In the experiments of table II, the initial coal samples were 100%+45-40 mesh particle size and the treatment lasted for five minutes at 673° C. In the experiment of table III, the procedure and materials was the same as in the experiment of table II, but the cofluidized bed was treated for 15 minutes. The average diameter of the coal particles at the outset is given as $\bar{d}_o$. The diameter of the coal particles after treatment is given as $\bar{d}_f$.

TABLE II

| | (5 min. run) | | | | |
|---|---|---|---|---|---|
| | 1 | 2 | 3 | 4 | |
| total wt. | 9.832 | 10.527 | 9.983 | 10.066 | g |
| +30 | 0.351 | 1.096 | 0.618 | 0.306 | g |
| +40-30 | 1.982 | 3.544 | 2.595 | 1.940 | g |
| +45-40 | 5.185 | 2.375 | 2.828 | 1.124 | g |
| +60-45 | 1.252 | 0.927 | 0.655 | 0.498 | g |
| +100-60 | 0.080 | 0.185 | 0.133 | 0.097 | g |
| −100 | 0.081 | 1.275 | 2.126 | 4.532 | g |
| lost | 0.901 | 1.125 | 0.877 | 1.569 | g |
| $\bar{d}_f$ | 433 | 507 | 521 | 457 | μ |
| $\bar{d}_o$ | 385.5 | 385.5 | 385.5 | 385.5 | μ |
| I | 1.12 | 1.32 | 1.35 | 1.18 | |
| C | 0.036 | 0.104 | 0.062 | 0.030 | |
| % iron | 0 | 18.8 | 30.0 | 60.2 | |

TABLE III

| | (15 min. run) | | | | |
|---|---|---|---|---|---|
| | 5 | 6 | 7 | 8 | |
| total wt. | 9.974 | 9.004 | 10.020 | 10.025 | g |
| +30 | 0.249* | 1.207 | 0.444 | 0.285 | g |
| +40-30 | 1.306 | 2.883 | 3.694 | 2.535 | g |
| +45-40 | 3.781 | 2.169 | 1.777 | 0.490 | g |
| +60-45 | 0.670 | 0.571 | 0.567 | 0.383 | g |
| +100-60 | 0.109 | 0.155 | 0.193 | 0.141 | g |
| −100 | 0.118 | 0.954 | 1.194 | 4.208 | g |
| lost | 0.998 | 1.065 | 1.403 | 1.983 | g |
| $\bar{d}_f$ | 3600 | 790 | 497 | 494 | μ |
| $\bar{d}_o$ | 385.5 | 385.5 | 385.5 | 385.5 | μ |
| I | 9.35 | 2.05 | 1.29 | 1.28 | |
| C | 0.300 | 0.134 | 0.044 | 0.028 | |
| % iron | 0 | 16.6 | 30.2 | 60.0 | |

*Run No. 5 also contained a large 10,000μ particle of weight 2.744 g

Figure 6:
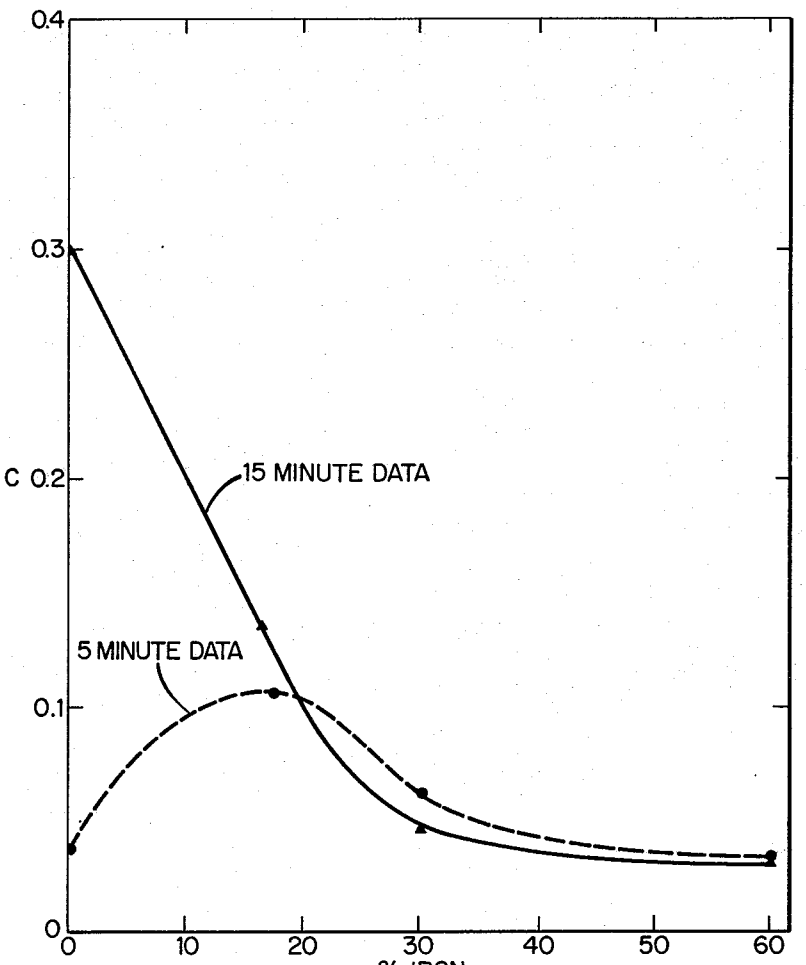
FIG. 6 is a graph similar to that of FIG. 5 except that the percentage by weight iron versus "C", a second indirect measure of the degree of agglomeration.
Figure 5:
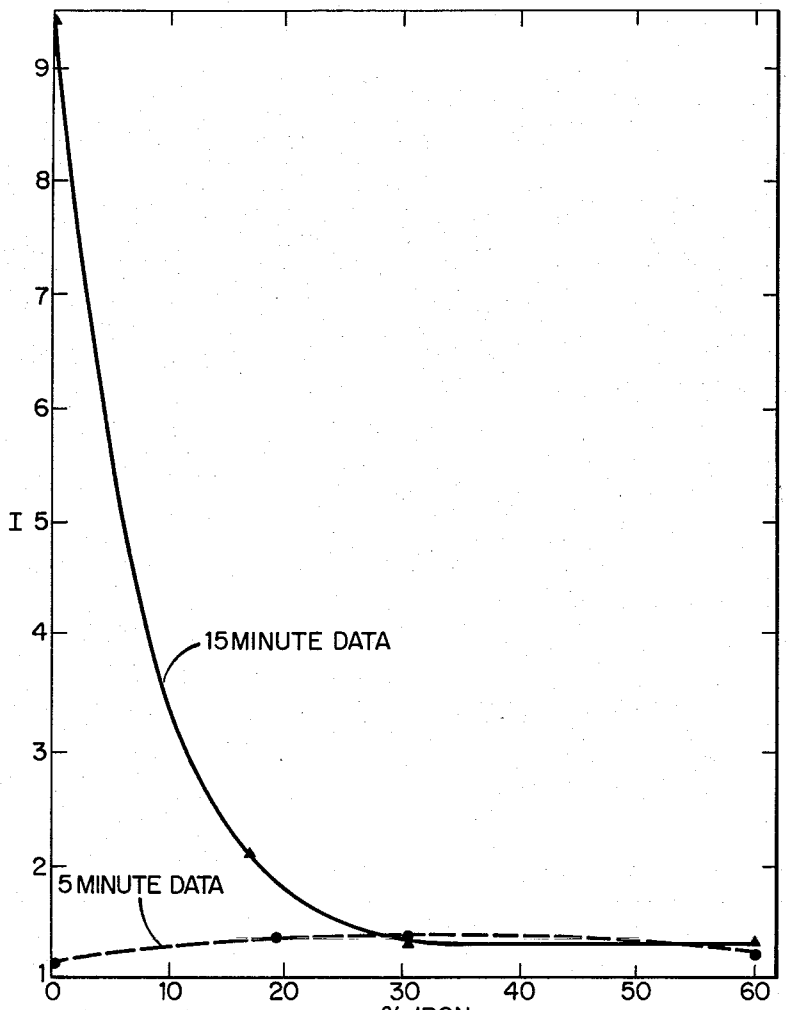
FIG. 5 is a graph of weight percent iron in the iron-carbonaceous particle cofluidized bed versus "I", a first indication of the degree of agglomeration.

Certain aspects of the data are illustrated in graphical form in FIGS. 5 and 6. FIG. 5 charts I versus the weight percent iron in the charge. FIG. 6 shows the relationship of C versus the percent iron in the charge.

As can be seen from the data of Table II and FIG. 5, the values of I, the ratio of final to initial average diameter, for the five minute run indicate that the addition of 18 and 30 weight percent iron actually results in increases in average particle size after treatment as compared to the pure coal beds. The 60 weight percent iron charge tends to produce a value of I closer to that of the pure coal bed. Significant amounts of iron were observed in the large agglomerations formed in samples 2 and 3.

With respect to the values of the ratio of "klinker" weight to total weight, (FIG. 6 and Table III) it can be seen that the 18% iron charge is much worse than the others, and that the 60% iron charge is most effective among those tested in combating klinker formation. It should be noted that the foregoing data are based on 5 minute runs, i.e., runs too short to illustrate the decidedly beneficial effect which may be obtained if higher weight percentages of iron are used. At the temperature and time employed in the experiments of Table II, only small amounts of gas would be produced. However, these data are helpful in understanding the behavior of the cofluidized bed.

The experiments of Table III, on the other hand, were run for a sufficient amount of time (15 minutes) to initiate gas production at the rather low temperature of the experiments. Inspection of the data disclosed in Table III and in FIGS. 5 and 6 clearly demonstrate the advantages achievable by the discovery of the invention.

As can be seen from these data, the pure coal bed (run no. 5) was almost completely caked. After a sufficient warm up, that is, after sufficient time has elapsed to heat the coal up to the temperature where the sticky surface liquids are produced, most of the coal particles stick together. However, in the series of runs at 15 minutes, each additional weight of iron was found to improve the agglomeration problem. Specifically, the 16% iron bed was enormously better behaved, as indicated by the lower values of I and C, despite the better heat transport of the first few minutes due to the addition of the thermally conductive iron particles. Each additional increment helped to a substantial but decreasing degree. The large particles formed in run 5 proved to be virtually indestructible. In contrast, in the other 15 minute runs, the larger agglomerates were largely broken up, especially for the 30 and 60 weight percent iron cases. Accordingly, it must be concluded that the coal-coal growth produces a much stronger agglomerate than an iron-coal growth.

An overview of the foregoing leads to the conclusion that, at a residence time sufficient to initiate gasification of the coal particles, even 16% iron in the charge represents a significant improvement. However, as mentioned previously, these experiments were conducted at a relatively low operating temperature. When operating at higher, more favorable temperatures, at least about 30% iron must be added to obtain the anti-agglomeration effect, and indeed, at temperatures around 850° K. or higher, at least 60%, and preferably 90% or above, by weight iron should be included in the cofluidized mixture.

In summary, when operating the gas producing reactor 10 under proper time and temperature conditions to effect the desired reactions, it is necessary to cofluidize at least 30% by weight iron with the carbonaceous particles. As shown in FIGS. 5 and 6, operation within this range significantly decreases the agglomeration, thus stabilizing the cofluidization process and maximizing reaction rates.

Reducing the FeO Produced

In order to design an economically attractive coal gasification process, it is necessary that the FeO produced as a product of the reactions taking place in gas producing zone 10 be rapidly and inexpensively reduced to iron so that it can be recirculated. Accordingly, in its most basic aspects, the process of the invention includes the step of preparing the FeO for recycling by reducing it in a reduction zone 18. There are many known methods of reducing the FeO that can be utilized in reduction zone 18. However, in accordance with another aspect of the invention, there are two methods of regenerating the iron which are preferred.

Figure 2:
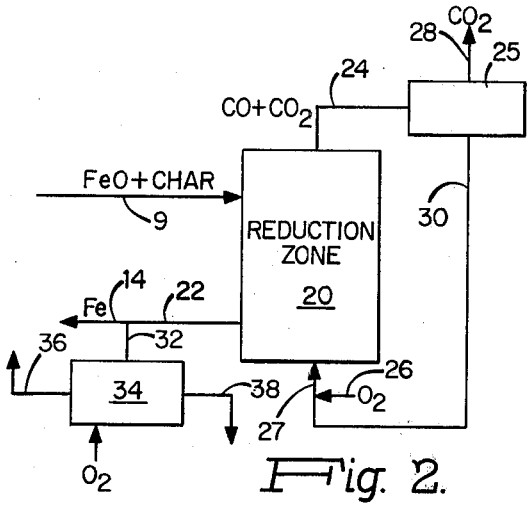
FIG. 2 is a diagram schematically illustrating the carbon monoxide iron reduction process.

The first of these two methods is illustrated in FIG. 2. A solid stream of FeO plus char from the gas production zone 10 enters the reduction zone 20 at a point adjacent the top of the reaction container. The reduction zone 20 is fed with carbon monoxide and carbon dioxide and operated under conditions to drive the chemical equilibrium toward the formation of carbon dioxide at the expense of the formation of iron oxides. Specifically, carbon monoxide is converted to carbon dioxide while iron oxide is converted to iron in accordance with the following equation:

$$FeO+CO \rightleftharpoons CO_2+Fe$$

A portion of the char introduced together with the FeO reacts with carbon dioxide to form carbon monoxide. Furthermore, iron oxide is reduced by the char with carbon monoxide as a by-product. However, this FeO reduction is not significant as compared to the reduction with carbon monoxide since reactions between solids are slower than reactions between a solid and a gas.

The pressure is chosen so that the flow of solids and gases within the container in the overall process is operable on a continuous basis. Thus, the pressure in the reduction zone must overcome the pressure drop normally encountered when solids and gases are being moved over a distance. Reasonable chemical equilibrium conditions favoring the formation of carbon dioxide can be obtained when the pressure in the reduction zone is maintained between 1 and 45 atmospheres, preferably between 1 and 10 atmospheres. While equilibrium considerations favor the use of as high a temperature as possible, the maximum temperature in the zone must be limited in order to avoid sintering the solid materials.

Given these limitations, reasonable chemical equilibrium conditions can be maintained when the temperature in the zone is between about 900° and 1300° K., preferably between 1200° and 1300° K. Under these conditions, solid particulate matter rich in iron may be removed from the bottom of the reduction zone as a solid stream 22. The gaseous effluent, carbon dioxide and carbon monoxide, leaves through the top of the container via gas stream 24.

In this embodiment of the process of the invention, it is essential to provide heat to the reduction zone. Accordingly, a portion of the incoming carbon monoxide reducing gas can be oxidized at 26 to maintain the temperature. However, it is important that the mole ratio of carbon dioxide to carbon monoxide in the reducing gas stream entering the regenerator bed be below that allowed by the equilibrium relation governing the formation of iron oxide from metallic iron. If the mole ratio of carbon dioxide to carbon monoxide in the stream exceeds the equilibrium ratio, excessive amounts of iron oxide are formed by oxidation of iron by the carbon dioxide.

Preferably, as suggested in FIG. 2, the FeO-char solid stream is introduced into the reduction zone so that it flows counter-currently to the reducing gas stream. This can be accomplished by introducing the iron oxide solid stream into the top of the regenerator zone while the reducing gas stream is introduced at the bottom. Accordingly, it is possible to operate the reduction zone as a relatively dense fluidized bed in which case the solids are well mixed. Of course, the rates at which the respective gas and solid streams are introduced into the zone are regulated to effect the cofluidization.

Substantial advantages are obtained by operating the regeneration zone in the manner as described above. First, the net reaction in the zone is:

$$C+2FeO \rightarrow CO_2+2Fe$$

Thus, each mole of carbon reduces 2 moles of iron oxide. However, because the reaction takes place in steps, namely $$C+CO_2 \rightarrow 2CO; \text{ and}$$

$$CO+FeO \rightarrow CO_2+Fe$$

the reaction rates are those of gas-solid reactions instead of the slower solid-solid reactions. Second, the combustion of a small portion of the recycled carbon monoxide stream supplies the heat required by the reaction without the risk of oxidizing the iron in the regeneration zone which would occur if oxygen were introduced directly. Third, since the effluent stream 24 from zone 20 comprises a mixture of carbon monoxide and carbon dioxide, it can serve as a ready source of carbon monoxide. The stream 24 leads to a separator or scrubber 25 where at least a portion of the carbon dioxide is removed via stream 28. Thus, the oxygen first introduced as steam in the gas producing zone is removed as carbon dioxide in scrubber 25. The now carbon monoxide rich stream 30 is then in part oxidized at 26 as described above and introduced into the bottom of the reduction zone 20.

The iron rich solid stream 22 is recycled to the gas producing zone 10. To prevent the build-up of ash and sulfides within the system, a side stream 32 may be utilized to remove ash on a continuous basis. Generally, the amount of solid diverted to stream 32 is governed by the amounts of sulfur and ash in the particular carbonaceous feed selected. The solids in stream 32 are passed through a zone 34 where they are contacted with oxygen in order to convert any sulfides therein to sulfur dioxide. The sulfur dioxide can be recovered as a relatively pure stream from outlet 36. The depleted ash is removed through solid stream 38. Since many coal deposits contain substantial amounts of iron as an impurity, it may not be necessary to add make-up iron in many cases.

Figure 4:
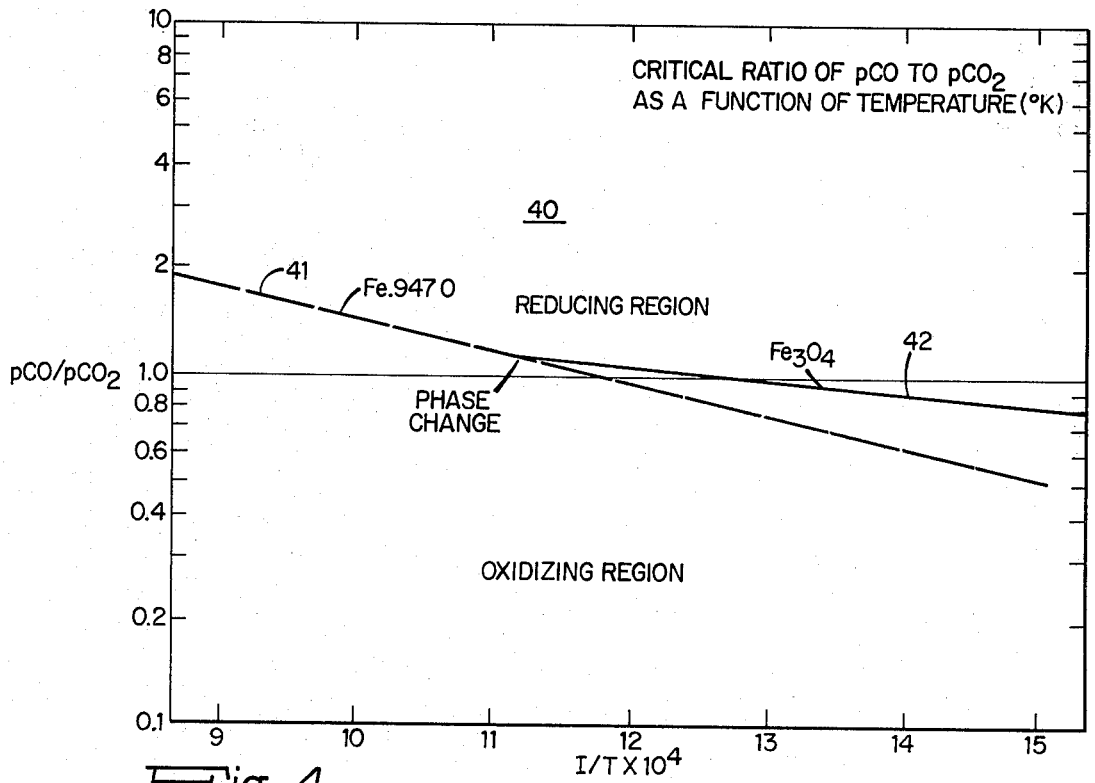
FIG. 4 is a graph of the relationship between temperature and the ratio of the partial pressures (mole ratio) of carbon monoxide to carbon dioxide in the incoming gas stream of the reduction zone as utilized in the carbon monoxide iron reduction process.

Referring to FIG. 4, the area 40 above the intersecting curves 41 and 42 represents the operating conditions of temperature and $CO/CO_2$ mole ratio (partial pressure ratio) for satisfactory reduction of FeO. Area 40 represents a $CO/CO_2$ mole ratios greater than that allowed by chemical equilibrium for iron oxidation.

Figure 3:
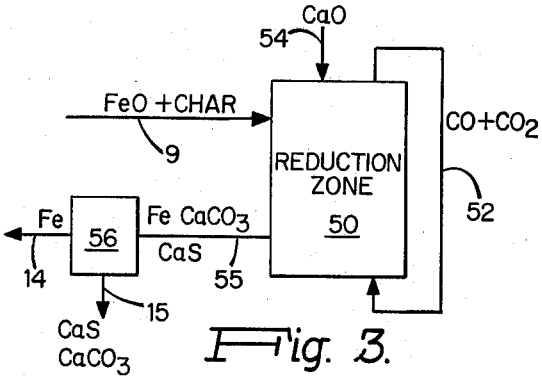
FIG. 3 is a diagram schematically illustrating the calcium oxide iron reduction process.

Referring to FIG. 3, a second preferred iron oxide regeneration scheme is illustrated. As will be apparent from the following description, this embodiment has certain advantages which make it highly attractive.

Iron oxide and char particles entering from the gas producing zone 10 are mixed in container 50 with particulate calcium oxide introduced at stream 54 having a particle size suitable for cofluidization with the iron oxide. A mixed gaseous stream of carbon monoxide and carbon dioxide passes countercurrently to the CaO-FeO-char solid mixture via stream 52. Advantageously, sulfur and oxygen is removed from association with the iron by the formation of calcium sulfide and calcium carbonate. These salts may be separated from the iron particles by a mechanical separation process at 56 based on the difference in particle size. For example, screens may be used to advantage.

The temperature restrictions remain the same as disclosed above. However, pressure parameters are considerably alleviated as compared to the above disclosed regeneration process so that quite high pressures are now allowable. This is because $$CaO+C+2FeO \rightarrow CaCO_3+2Fe$$

$$\Delta H=-18.9 \text{ Kcal}$$

This net reaction is independent of pressure, i.e., involve only solid reactants and products. However, the kinetics of the process are attractive because this reaction is not a purely solid stage reaction. Rather the route is:

$$C+CO_2 \rightleftarrows 2CO$$

$$CO+FeO \rightleftarrows CO_2+Fe, \text{ and}$$

$$CO_2+CaO \rightarrow CaCO_3$$

Continuous circulation of carbon monoxide requires that some char be included with the iron oxide being regenerated. The net result of these reactions is that the oxygen is being removed via the solid calcium carbonate, and the $CO_2$ scrubber of the embodiment of FIG. 2 may be eliminated.

This system has several advantages. First, it allows for operation of both the reduction zone and the gas producing zone at the same or close to the same pressure while simultaneously relieving the oxygen requirement. Second, complete separation or removal of $CaO/CaCO_3/CaS$ is unnecessary. Third, the reaction of $CO_2$ with CaO is highly exothermic and can supply the heat necessary to maintain the reaction temperature. Sulfur is removed by an analogous reaction wherein:

$$CaO+FeS \rightarrow CaS+FeO$$

Again, this is not a solid phase reaction, but rather proceeds via gaseous intermediates.

In both the above disclosed iron oxide regeneration systems, ash may be removed by cyclones suitably situated in the gas stream.

The following examples are illustrative of the present invention and in no event should be construed to limit the same.

A computer simulation of the process disclosed above utilizing the regeneration system set forth in FIG. 2 gives the following results. (The stream and zone numbers correspond to those of FIGS. 1 and 2.)

TABLE IV

| | GAS STREAMS | | | | | | |
|---|---|---|---|---|---|---|---|
| Stream No: | 13 | 16 | 26 | 27 | 30 | 24 | 28 |
| Mols/sec | .6458 | 1.0 | .188 | 1.43 | 1.43 | 2.07 | .64 |
| Pressure Atm | 50 | 50 | 6 | 6 | 6 | 4 | 1 |
| Temp. K° | 973 | 373 | 1173 | — | 1173 | 1173 | — |
| Composition (Mol fraction) | | | | | | | |
| $O_2$ | 0 | — | 1.0 | — | — | — | — |
| CO | .014 | — | — | .738 | .999 | .691 | — |
| $CO_2$ | .009 | — | — | .263 | .001 | .309 | 1.0 |
| $CH_4$ | .571 | — | — | — | — | — | — |
| $H_2$ | .286 | — | — | — | — | — | — |
| $H_2O$ | .120 | 1.0 | — | — | — | — | — |
| $H_2S$ | .0003 | — | — | — | — | — | — |
| $SO_2$ | — | — | — | — | — | Negl. | Negl. |

TABLE IV-continued

| | SOLID STREAMS | | |
|---|---|---|---|
| Stream No: | 12 | 14 | 9 |
| Mols/sec | | | |
| Carbon | 1.023 | | .639 |
| Fe | | .902 | |
| FeO | | | .902 |
| TK° | 298 | 1173 | 973 |

As shown in Table IV, substantially complete conversion from steam to methane-hydrogen can be effected at moderate temperature and pressures without substantial formation of carbon monoxide by-product.

The following example illustrates the process of the invention utilizing the regeneration scheme of FIG. 3. (The stream and zone numbers correspond to those of FIGS. 1 and 3).

TABLE V

| | Gas Streams | | |
|---|---|---|---|
| Stream Nos. | 16 | 13 | 52 |
| Mols/sec. | 1.0 | .6458 | 2.07 |
| Pressure (atm) | 50 | 50 | 4 |
| Pemp K° | 373 | 973 | 1173 |
| Composition (mole fraction) | | | |
| $O_2$ | — | 0 | — |
| CO | — | .014 | .691 |
| $CO_2$ | — | .009 | .309 |
| $CH_4$ | — | .571 | — |
| $H_2$ | — | .286 | — |
| $H_2O$ | 1.0 | .120 | — |
| $H_2S$ | — | .0003 | — |
| $SO_2$ | — | — | Negl. |

| | SOLID STREAMS | | | | |
|---|---|---|---|---|---|
| Stream No: | 12 | 9 | 14 | 15 | 54 |
| Mols/sec: | | | | | |
| C | 1.023 | .639 | — | — | — |
| Fe | — | — | .902 | — | — |
| FeO | — | .902 | — | — | — |
| CaO | — | — | — | — | .640 |
| $CaS/CaCO_3$ | — | — | — | .640 | — |
| Temp (K°) | 298 | 973 | 1173 | 1173 | 298 |

As can be seen from the foregoing, low molecular weight hydrocarbons (here $CH_4$ gas) can be produced with little carbon monoxide or hydrogen sulfide contamination, and sulfur is removed as CaS.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A process for forming a low molecular weight hydrocarbon-rich gas from solid carbonaceous particles, metallic iron particles, and steam in a manner to minimize agglomeration of said particles, said process being characterized by the steps of:

(1) cofluidizing the carbonaceous particles with at least about 60 percent by weight metallic iron particles in a gas producing zone, the ratio of the diameter of the iron and carbonaceous material particles being fixed in a relationship to their densities to maintain cofluidization of the particle mixture;

(2) contacting the cofluidized metallic iron and carbonaceous particles with steam at a temperature between about 800° and 1125° K. and a pressure between 1 and 100 atmospheres;

(3) recovering a low molecular weight hydrocarbon-rich gas by removing it from said gas producing zone;

(4) transporting a solid stream rich in FeO produced in said producing zone to a reduction zone;

(5) contacting said solid stream with a gas stream containing carbon monoxide and carbon dioxide, said gas stream having a carbon monoxide to carbon dioxide mole ratio selected to favor the production of iron in the reaction:

$$CO+FeO \rightarrow CO_2+Fe$$

said gas stream being at a temperature between about 900° and 1300° K. and a pressure between about 1 and 45 atmospheres;

(6) forming a carbon monoxide-rich gas stream from effluent from said reduction zone by removing carbon dioxide from said effluent and recycling the stream to the reduction zone; and (7) recycling the iron particles produced in step (5) to said producing zone.

2. The process as set forth in claim 1 wherein said carbonaceous particles comprise bituminous coal particles.

3. The process as set forth in claim 1 wherein the temperature is at least about 850° K. and the percent iron is at least 90.

4. The process as set forth in claim 1 wherein the pressure is between 20 and 100 atmospheres.

5. The process as set forth in claim 1 wherein the carbonaceous material particles and iron particles have respective diameters which vary within the range which is operable for cofluidizing said particles.

6. The process as set forth in claim 1 wherein, in the reduction zone, the temperature and CO to $CO_2$ mole ratio are within area 40 of FIG. 4 of the drawing.

7. The process as set forth in claim 1 wherein sulfur is removed from the reduction zone by removing a portion of the solids contained therein and oxidizing sulfur containing components of the solids to form sulfur oxides.

8. The process as set forth in claim 1 wherein heat is supplied to the reduction zone by oxidizing a portion of the CO in the stream produced in step 6.

9. A process for forming a low molecular weight hydrocarbon-rich gas from solid carbonaceous particles, metallic iron particles, and steam in a manner to minimize agglomeration of said particles, said process being characterized by the steps of:

(1) cofluidizing the carbonaceous particles with at least about 60 percent by weight metallic iron particles in a gas producing zone, the ratio of the diameters of the iron and carbonaceous material particles being fixed in a relationship to their densities to maintain cofluidization of the particle mixture:

(2) contacting the cofluidized metallic iron and carbonaceous particles with steam at a temperature between about 800° and 1125° K. and a pressure between 1 and 100 atmospheres;

(3) recovering a low moleclar weight hydrocarbon-rich gas by removing it from said gas producing zone;

(4) transporting a solid stream rich in FeO produced in said producing zone to a reduction zone;

(5) reducing said FeO in said reduction zone to iron particles by fluidizing the particles in said solid stream with a mixture of CO and $CO_2$ and particulate calcium oxide at a temperature between about 900° and 1300° K. to produce calcium compounds and Fe and isolating at least a portion of the calcium compounds from the remainder of the solids; and (6) recycling the iron particles produced in step (5) to said producing zone.

10. The process as set forth in claim 9 wherein the heat in the reduction zone is supplied by an exothermic reaction between $CO_2$ and CaO in said reduction zone.

11. The process as set forth in claim 9 wherein said solid stream also comprises sulfides, said sulfides are reacted with CaO in said reduction zone to produce calcium sulfide, and said calcium sulfide is removed from the remainder of the solids produced in step 5.

* * * * *